US010638566B2

(12) United States Patent
Chen et al.

(10) Patent No.: US 10,638,566 B2
(45) Date of Patent: Apr. 28, 2020

(54) LED DRIVER AND LED LAMP USING THE SAME

(71) Applicant: Current Lighting Solutions, LLC, East Cleveland, OH (US)

(72) Inventors: Longyu Chen, ShangHai (CN); Hongbin Wei, ShangHai (CN); Haomin Xu, ShangHai (CN)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 16/039,126

(22) Filed: Jul. 18, 2018

(65) Prior Publication Data

US 2019/0037659 A1 Jan. 31, 2019

(30) Foreign Application Priority Data

Jul. 28, 2017 (CN) ..... 2017 1 0629077

(51) Int. Cl.
*H05B 33/08* (2020.01)

(52) U.S. Cl.
CPC ..... *H05B 33/0845* (2013.01); *H05B 33/0818* (2013.01)

(58) Field of Classification Search
CPC ..... H05B 33/08; H05B 33/0818; H05B 33/0842; H05B 33/0845; H05B 33/089; H05B 37/02
See application file for complete search history.

(56) References Cited

U.S. PATENT DOCUMENTS

2008/0298088 A1* 12/2008 Shen ..... H05B 33/0887 363/20
2011/0080110 A1* 4/2011 Nuhfer ..... H05B 33/0815 315/291
2011/0121755 A1* 5/2011 Han ..... H05B 33/0815 315/294
2017/0325304 A1* 11/2017 Fu ..... H02M 1/08

* cited by examiner

*Primary Examiner* — Thai Pham
(74) *Attorney, Agent, or Firm* — Buckley, Maschoff & Talwalkar LLC

(57) ABSTRACT

The present disclosure discloses a light-emitting diode (LED) driver comprising a controller and a main circuit. The controller is configured to receive a dimming signal for dimming an LED load and use a current hysteresis control to generate a control signal, wherein a hysteresis width of the current hysteresis control varies with the dimming signal. The main circuit comprises a front-end stage configured to receive an AC input voltage and output a DC bus voltage, and a back-end stage configured to receive the bus voltage and responsive to the control signal, output a desired drive current through output terminals to the LED load so as to produce a target illumination intensity. The present disclosure widens the dimming depth of analog dimming in the LED dimming technology, achieves deep dimming and satisfies good dimming linearity in the entire dimming range.

10 Claims, 9 Drawing Sheets

LED DRIVER AND LED LAMP USING THE SAME

TECHNICAL FIELD

The present disclosure relates to a light-emitting diode (LED) driver, and in particular, to an LED driver with deep dimming performance and a LED lamp using the LED driver.

BACKGROUND OF THE INVENTION

In the field of LED drive technology, PWM dimming and analog dimming are two commonly used dimming techniques. Among them, the PWM dimming is often used in deep dimming applications. However, the PWM dimming current is chopped, which creates a large ripple on the output current and becomes a potential EMI interference source. The analog dimming has good performance when a dimming depth is relatively shallow, but when the deep dimming is required, the dimming depth that can be achieved by the analog dimming is limited by a maximum operating frequency allowed by the switching device, or it may be limited by a maximum ripple current of an inductor, which makes the inductor current intermittent and affects a linearity of the analog dimming.

Therefore, it is necessary to provide a method to solve at least one of the foregoing problems.

SUMMARY OF THE INVENTION

One aspect of the present disclosure provides a LED driver including a controller (20) and a main circuit (10). The controller (20) is configured to receive a dimming signal (DS) for dimming an LED load (30) and use a current hysteresis control (19) to generate a control signal (CS1), wherein a hysteresis width of the current hysteresis control varies with the dimming signal (DS). The main circuit (10) includes a front-end stage (11) configured to receive an AC input voltage (Vin) and output a DC bus voltage (Vbus), and a back-end stage (12) configured to receive the bus voltage (Vbus) and responsive to the control signal (CS1), output a desired drive current through output terminals to the LED load (30) so as to produce a target illumination intensity.

Another aspect of the present disclosure provides a LED Lamp for connecting to an external power supply. The LED lamp includes an LED load (30) including a plurality of LEDs; and the foregoing LED driver configured for driving the LED load (30).

BRIEF DESCRIPTION OF THE DRAWINGS

These and other features, aspects and advantages of the present disclosure will become better understood when the following detailed description is read with reference to the accompanying drawings, in which like reference numerals are used throughout the drawings to refer to like parts, where.

DETAILED DESCRIPTION OF THE INVENTION

The specific embodiments of the present disclosure will be described in detail below with reference to the accompanying drawings in order to facilitate those skilled in the art to fully understand the subject matter claimed by the present disclosure. In the following detailed description of these specific embodiments, the present specification does not describe in detail any of the known functions or configurations, to avoid unnecessary details that may affect the disclosure of the present disclosure.

Unless otherwise defined, the technical and scientific terms used in the claims and the specification are as they are usually understood by those skilled in the art to which the present disclosure pertains. "First", "second" and similar words used in the specification and the claims do not denote any order, quantity or importance, but are merely intended to distinguish between different constituents. The terms "one", "a" and similar words are not meant to be limiting, but rather denote the presence of at least one. "Comprising", "consisting of" and similar words mean that the elements or articles appearing before "comprising" or "consisting of" include the elements or articles and their equivalent elements appearing behind "comprising" or "consisting of", not excluding any other elements or articles. "Connected", "coupled" and similar words are not restricted to physical or mechanical connections, but may also include electrical connections, whether direct or indirect.

Figure 1:
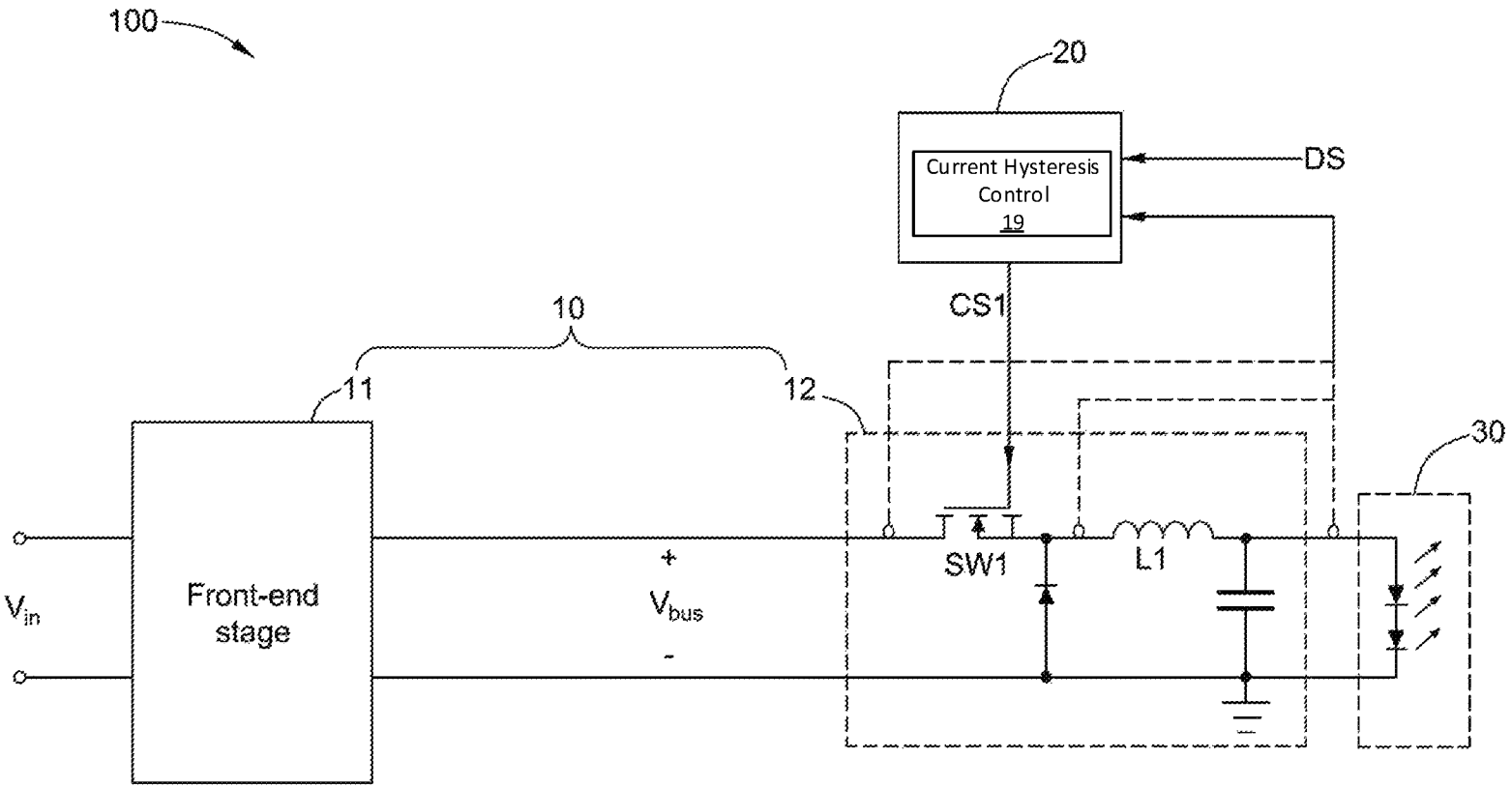
FIG. 1 is an exemplary circuit block diagram of an LED driver according to a specific embodiment of the present disclosure.

FIG. 1 shows an exemplary block diagram of an LED driver 100 according to a specific embodiment of the present disclosure. As shown in FIG. 1, the LED driving circuit 100 includes a main circuit 10 and a controller 20. The controller 20 receives a dimming signal DS indicating an illumination intensity of an LED load 30, and uses a current hysteresis control 19 according to the dimming signal DS to generate a control signal. The control signal is supplied to the main circuit 10, wherein a hysteresis width of the current hysteresis control varies with the dimming signal DS. The main circuit 10 includes a front-end stage 11 and a back-end stage 12. The front-end stage 11 receives an AC input voltage Vin externally, and finally outputs a DC bus voltage Vbus after a certain control. The back-end stage 12 is connected to the front-end stage 11 to receive the bus voltage Vbus, and then a constant current output is achieved based on the control signal, and a desired drive current is provided to the LED load 30 through output terminals. The drive current can enable the LED load 30 to produce a target illumination intensity. Among them, the front-end stage 11 has a variety of topologies and control methods, which may achieve a AC-DC conversion and output a constant DC voltage. In some embodiments, the front-end stage 11 may further include a function of power factor correction control. The dimming signal DS is generated externally and transmitted to the controller 20, which may be an analog signal or a digital signal.

In existing analog dimming schemes, the hysteresis width of the current hysteresis control is always fixed. So, when a dimming depth increases, an inductor current may be intermittent, which affects a linearity of the analog dimming. In order to solve this problem, the present disclosure provides a technical solution in which the hysteresis width is adjustable, that is, the hysteresis width is determined according to the dimming signal. When the dimming depth increases, the hysteresis width is reduced accordingly, thereby extending the dimming depth achieved by the analog dimming and achieving a good dimming linearity throughout an entire dimming range.

Figure 2:
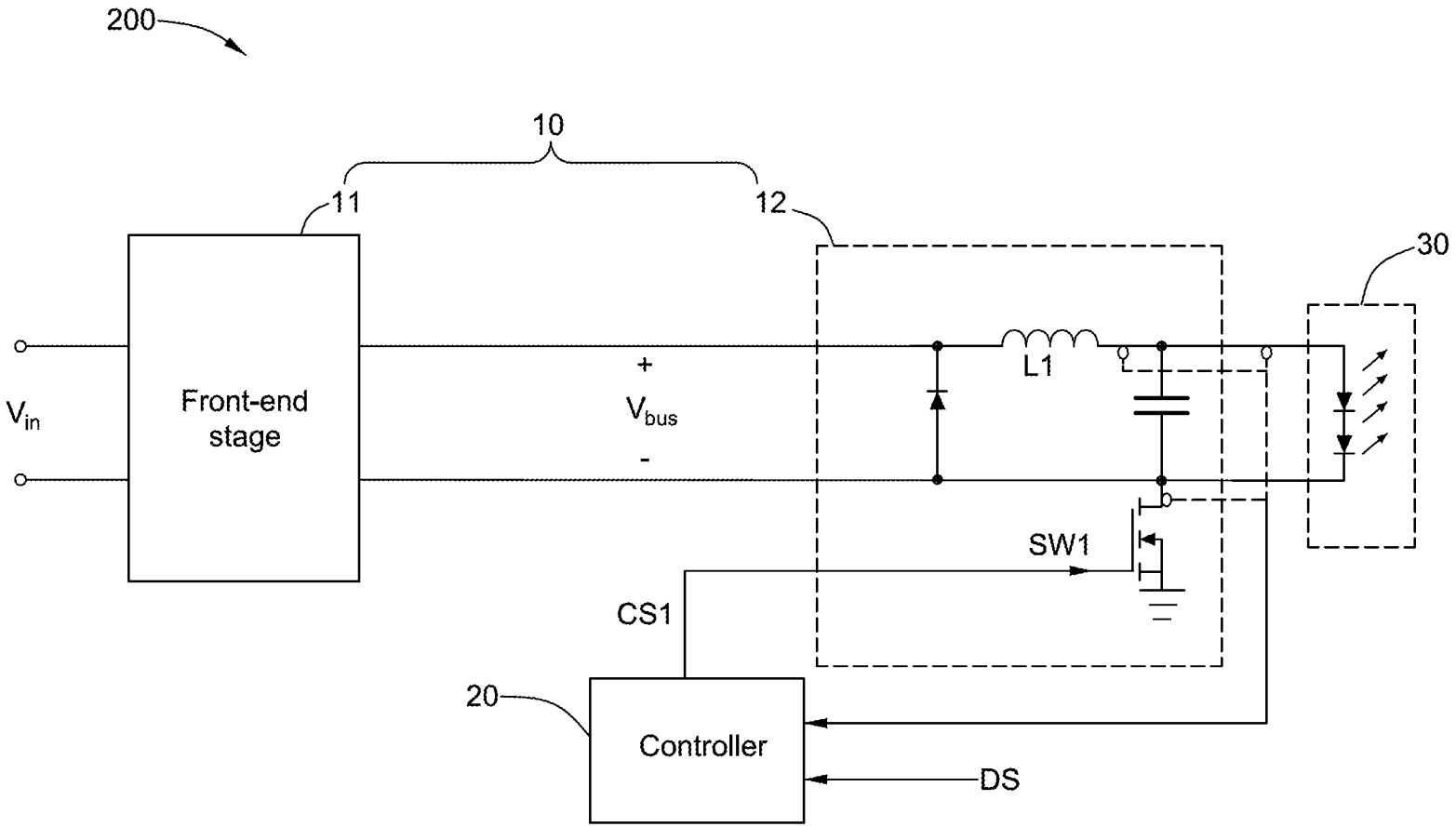
FIG. 2 is an exemplary circuit block diagram of an LED driver according to another specific embodiment of the present disclosure.

Further referring to FIG. 1, the back-end stage 12 is, for example a buck circuit, including a controllable switch SW1, a diode and an inductor L1. In the present embodiment, the buck circuit 12 further includes a capacitor for filtering, and the buck circuit 12 in FIG. 1 adopts a switch floating topology, in this topology, the controllable switch SW1 is not grounded. FIG. 2 is an exemplary circuit block diagram of an LED driver 200 according to another embodiment of the present disclosure. Compared with FIG. 1, FIG. 2 differs only in that the buck circuit 12 adopts an output floating topology, in this topology, an output end of the buck circuit 12 is not grounded.

The two topologies shown in FIG. 1 and FIG. 2 are circuit topologies that are often applied in actual driver. The technical solution proposed by the present disclosure to broaden the analog dimming depth is applicable to the two types of topologies. For simplicity, in the subsequent description, only the topological structure shown in FIG. 1 will be taken as an example.

Figure 3:
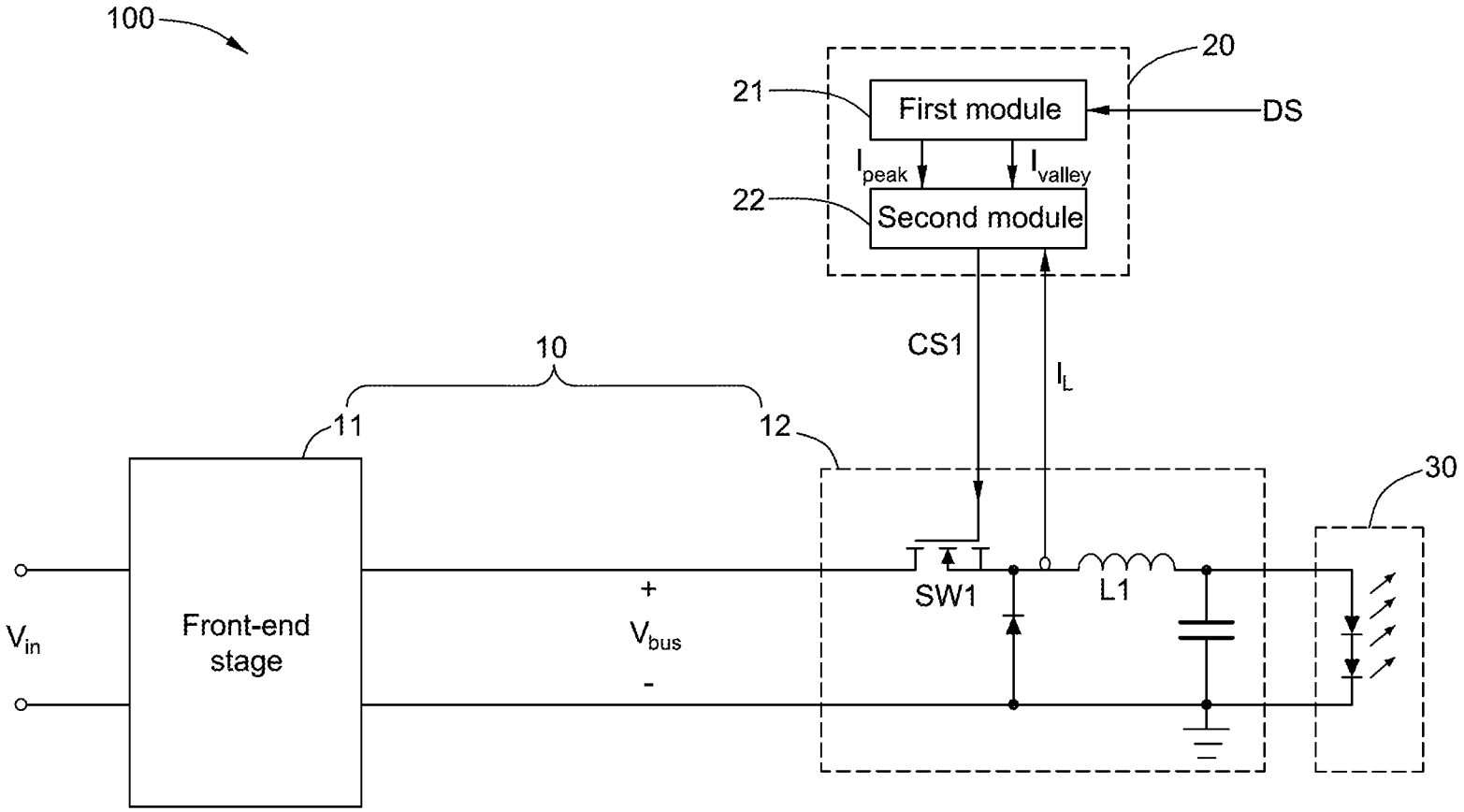
FIG. 3 is a specific circuit diagram of the LED driver shown in FIG. 1.

FIG. 3 shows a circuit structure diagram according to one embodiment. As shown in FIG. 3, the controller 20 includes a first module 21 and a second module 22. The first module 21 receives the dimming signal DS and determines an upper limit current $I_{peak}$ and a lower limit current $I_{valley}$ of the current hysteresis control based on the dimming signal DS, wherein the difference between the upper limit current $I_{peak}$ and the lower limit current $I_{valley}$ is the hysteresis width. The second module 22 detects an inductor current $I_L$ flowing through the inductor L1, and generates a control signal CS1 combined with an output of the first module 21 to switch on or switch off the controllable switch SW1. Specifically, when the inductor current $I_L$ reaches the upper limit current $I_{peak}$, the controllable switch SW1 is switched off, and when the inductor current $I_L$ reaches the lower limit current $I_{valley}$, the controllable switch SW1 is switched on.

Figure 4:
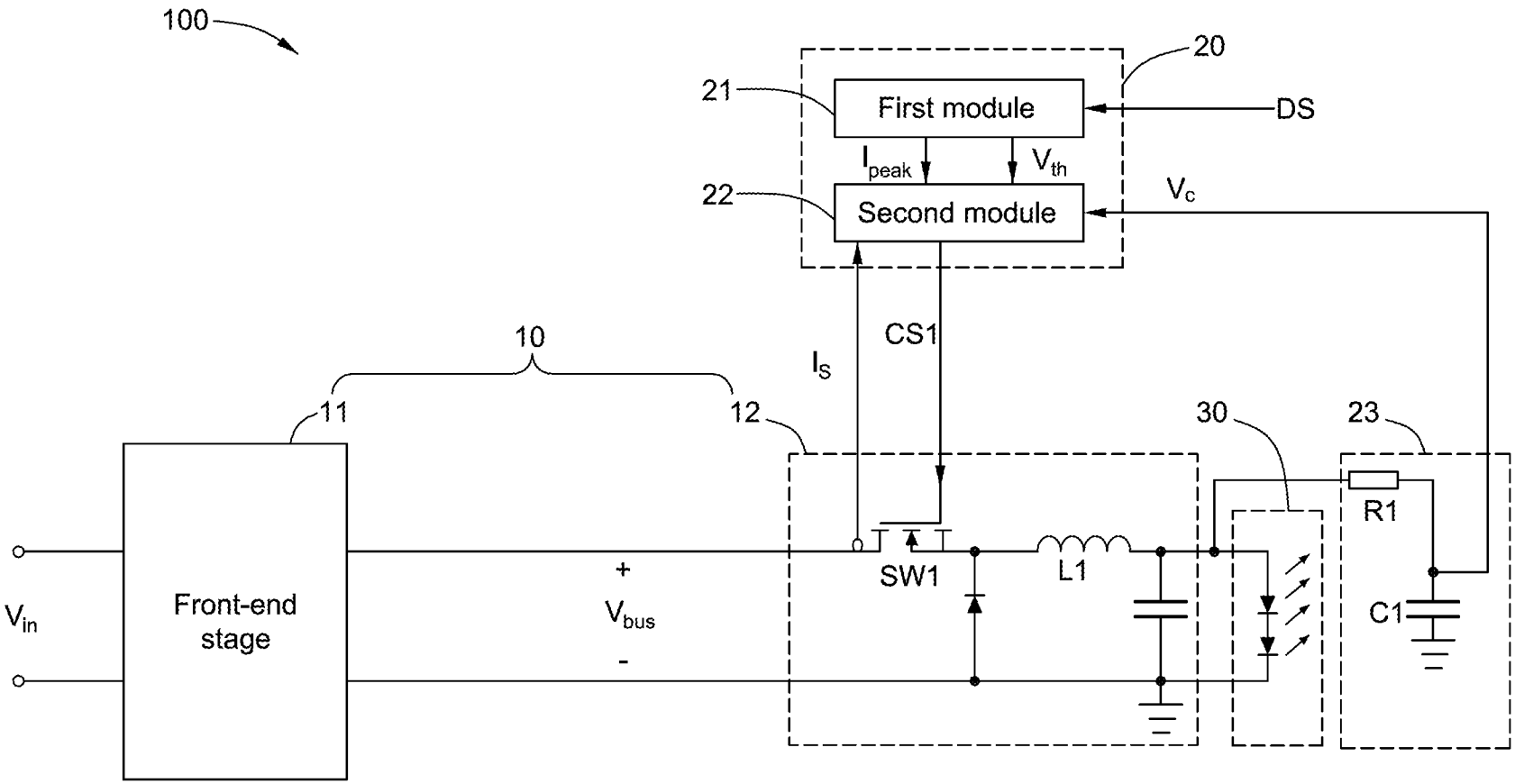
FIG. 4 is another specific circuit diagram of the LED driver shown in FIG. 1.

FIG. 4 shows a circuit structure diagram according to another embodiment. As shown in FIG. 4, the controller 20 includes the first module 21, the second module 22, and an auxiliary circuit 23. The first module 21 receives the dimming signal DS and determines the upper limit current $I_{peak}$ according to the dimming signal DS. The auxiliary circuit 23 includes an auxiliary capacitor C1 and an auxiliary resistor R1. One terminal of the auxiliary capacitor C1 is grounded, and the other terminal of the auxiliary capacitor C1 is connected with one terminal of the auxiliary resistor R1. The other terminal of the auxiliary resistor R1 is connected with a positive terminal of the output terminal, and the other terminal of the auxiliary capacitor C1 is connected to the second module 22 so as to provide a capacitor voltage $V_C$ of the auxiliary capacitor C1 to the second module 22.

The second module 22 detects the switch current $I_S$ flowing through the controllable switch SW1, and generates the control signal CS1 and the capacitor voltage $V_C$ provided by the auxiliary circuit in combination with the output of the first module 21 to switch on or switch off the controllable switch SW1. The specific process is comparing a switch current $I_S$ with the upper limit current value $I_{peak}$, when the switch current $I_S$ reaches the upper limit current $I_{peak}$, the controllable switch SW1 is switched off, and the switch current $I_S$ begins to fall. When the capacitor voltage $V_C$ reaches a threshold voltage $V_{th}$, the controllable switch SW1 is switched on; and the switch current $I_S$ begins to rise. These two steps are continuously alternated to achieve the current hysteresis control. After an inductance of the inductor L1 is determined, the hysteresis width is determined by a charging time required by the auxiliary capacitor C1 charged from zero voltage to the threshold voltage $V_{th}$. Wherein, the auxiliary circuit 23 further includes a discharge circuit (not shown). When the auxiliary capacitor C1 is charged until the capacitor voltage VC reaches the threshold voltage $V_{th}$ and the controllable switch SW1 is switched on, the discharge circuit starts automatically to make the auxiliary capacitor C1 be discharged to zero voltage, and keep the zero voltage until the controllable switch SW1 is turned off. Then auxiliary capacitor C1 starts to charge, and it cycles continuously.

The present disclosure achieves the purpose of adjusting the hysteresis width by controlling the charging time of the auxiliary capacitor C1. The factors affecting the charging time of the auxiliary capacitor include: the selection of the threshold voltage $V_{th}$, the capacitance of the auxiliary capacitor C1, a resistance of the auxiliary resistor R1, and an average charging current of the auxiliary capacitor C1. Therefore, the hysteresis width can be adjusted by adjusting one of the above factors that affect the charging time.

Further referring to FIG. 4, the first module 21 is further configured to produce the threshold voltage $V_{th}$ based on the dimming signal DS to the second module 22, thus the hysteresis width is changed by adjusting the threshold voltage $V_{th}$.

Figure 5:
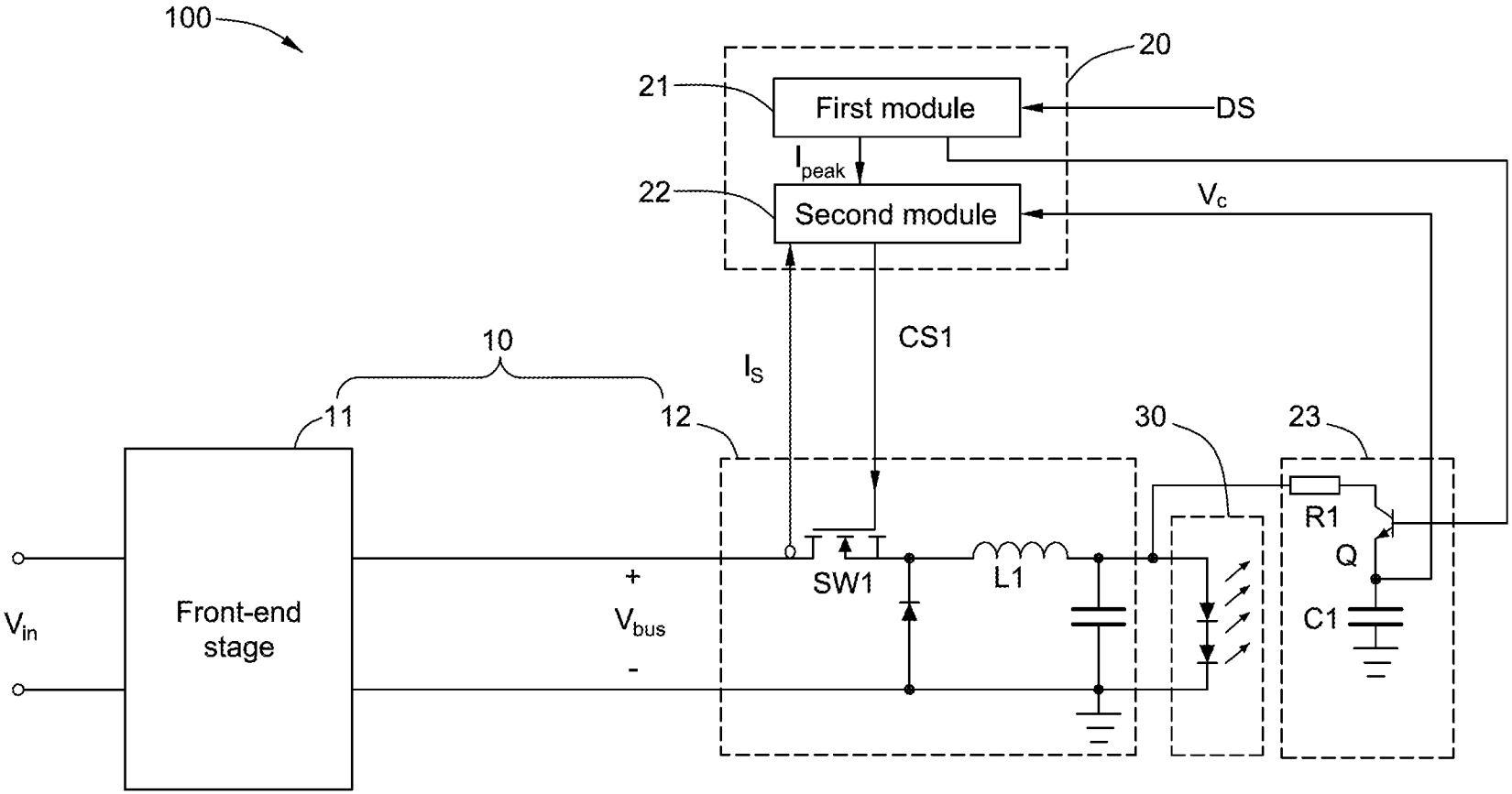
FIG. 5 is yet another specific circuit diagram of the LED driver shown in FIG. 1.

In another possible embodiment, as shown in FIG. 5, the auxiliary circuit 23 further includes a transistor Q connected in series between the auxiliary capacitor C1 and the auxiliary resistor R1. The first module 21 is further configured to provide an auxiliary control signal according to the dimming signal DS to a base electrode of the transistor Q for controlling an equivalent resistance of the transistor Q, and the charging time of the auxiliary capacitor C1 is adjusted by the equivalent resistance of the transistor Q, and the hysteresis width is adjusted accordingly.

Figure 6:
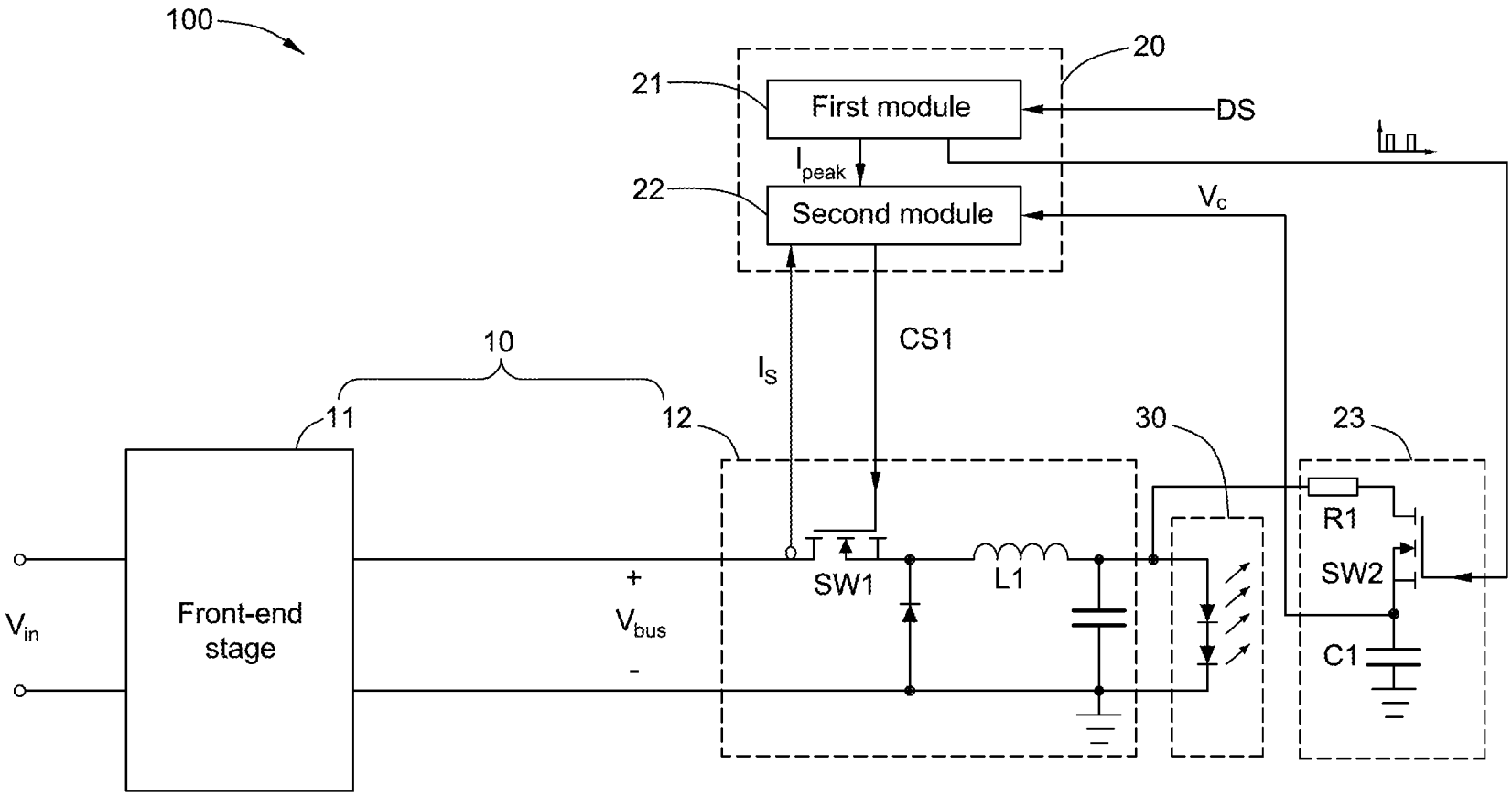
FIG. 6 is yet another specific circuit diagram of the LED driver shown in FIG. 1.

In another possible embodiment, as shown in FIG. 6, the auxiliary circuit 23 further includes a second controllable switch SW2 connected in series between the auxiliary capacitor C1 and the auxiliary resistor R1. The first module 21 is further configured to provide an auxiliary control signal according to the dimming signal DS to a control electrode of the second controllable switch SW2 for switching on or switching off the second controllable switch SW2. The auxiliary capacitor C1 can be charged only when the second controllable switch SW2 is turned on, thus, the actual average charging current of the auxiliary capacitor C1 is adjusted. Therefore, the charging time of the auxiliary capacitor is adjusted by adjusting an equivalent charging current of the auxiliary capacitor C1, and the hysteresis width is adjusted accordingly.

Figure 8:
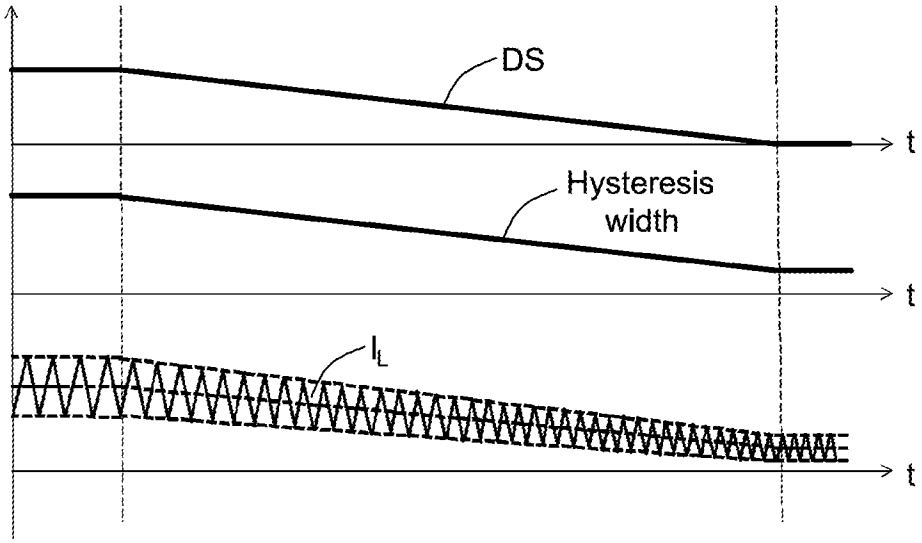
FIG. 8 is a waveform diagram of any of the LED driver shown in FIG. 3 to FIG. 6 under a continuous hysteresis width adjustment mode.

In the embodiments shown in FIGS. 3 to 6, the hysteresis width can be smoothly adjusted by the dimming signal DS. A curve of the hysteresis width changes with the dimming signal under a dimming mode is shown in FIG. 8. In FIG. 8, waveforms of the dimming signal DS, the hysteresis width, and the inductor current $I_L$ change with time are sequentially shown from top to bottom. Wherein, the hysteresis width changes continuously and smoothly with the dimming signal DS. The result is that the average value of the inductor current $I_L$ gradually reduces and the difference between the peak-to-peak values of the inductor current $I_L$ gradually decreases.

Figure 7:
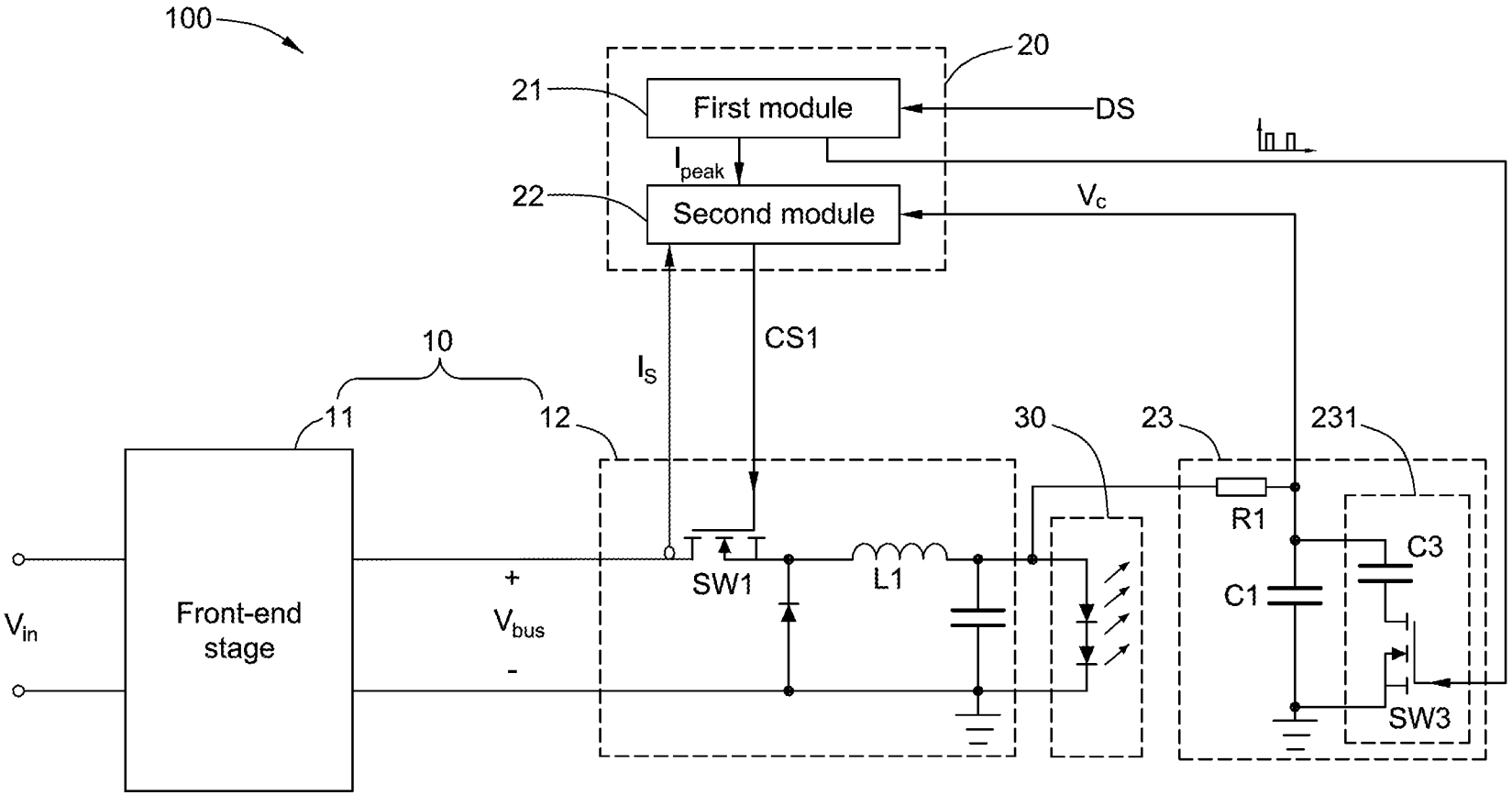
FIG. 7 is yet another specific circuit diagram of the LED driver shown in FIG. 1.

FIG. 7 shows a circuit structure diagram according to yet another embodiment. As shown in FIG. 7, an adjustment of the hysteresis width shows a stepwise change. In this embodiment, the hysteresis width includes a first hysteresis width and a second hysteresis width, wherein the first hysteresis width is greater than the second hysteresis width, and the hysteresis width selects one of the foregoing two according to the dimming signal DS. 1. The auxiliary circuit 23 further includes a branch 231 for changing the charging current of the auxiliary capacitor C1 based on the received dimming signal DS, thus the auxiliary capacitor C1 has a first charging time and a second charging time. When the dimming signal DS is above a predetermined value DS1, the auxiliary capacitor C1 has the first charging time and the first hysteresis width is generated; when the dimming signal DS is below the predetermined value DS1, the auxiliary capacitor C1 has the second charging time and the second hysteresis width is generated. The hysteresis width of this scheme can be stepwise changed with the dimming signal DS.

Further referring to FIG. 7, the branch 231 is connected in parallel with the auxiliary capacitor C1. The branch 231 includes a third auxiliary capacitor C3 and a third controllable switch SW3 connected in series. The first module 21 sends an auxiliary control signal according to the dimming signal DS to the control electrode of the third controllable switch SW3 to switch on or switch off the third controllable switch SW3. Specifically, when the dimming signal DS is above the predetermined value DS1, the third controllable switch SW3 is switched on. The third auxiliary capacitor C3 is connected in parallel with the auxiliary capacitor C1, the third auxiliary capacitor C3 is charged together with the auxiliary capacitor C1. The third auxiliary capacitor C3 divides a part of the charging current, the auxiliary capacitor C1 has the first charging current and the auxiliary capacitor C1 has the first charging time, corresponding to the first hysteresis width. When the dimming signal DS is below the predetermined value DS1, the third controllable switch SW3 is switched off. The third auxiliary capacitor C3 is not shunted, the auxiliary capacitor C1 has the second charging current and the auxiliary capacitor C1 has the second charging time, corresponding to the second hysteresis width. Therefore, in this solution, the on-off control of the third controllable switch SW3 is performed to adjust a charging duration of the auxiliary capacitor C1 in a segmented manner, thereby implementing the segmented adjustment of the hysteresis width.

Figure 9:
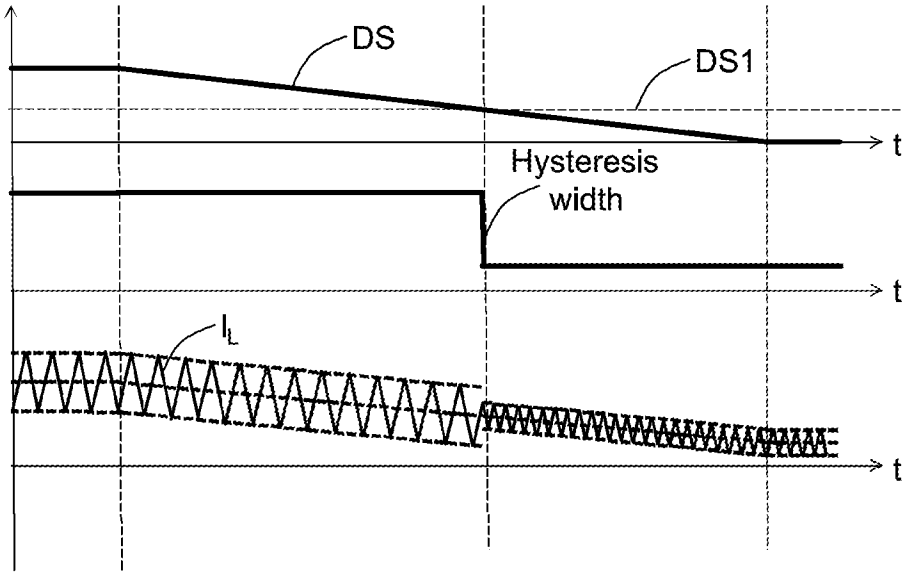
FIG. 9 is a waveform diagram of the LED driver shown in FIG. 7 under a segment hysteresis width regulation mode.

A curve of the hysteresis width with the dimming signal under the segment dimming mode is shown in FIG. 9. In FIG. 9, waveforms of the dimming signal DS, the hysteresis width, and the inductor current $I_L$ change with time are sequentially shown from top to bottom. Wherein, the hysteresis width changes stepwise with the dimming signal DS. Specifically, the predetermined value DS1 is used as a demarcation point, and the hysteresis width takes different values before and after it. The result is that the average value of the inductor current $I_L$ gradually reduces as the dimming signal DS reduces, and the difference between the peak-to-peak values of the inductor current $I_L$ changes stepwise as the hysteresis width changes.

The present disclosure also provides an LED lamp that is directly connected to an external commercial power supply. The LED lamp includes the LED load 30 including a plurality of light emitting diode units, and the above-described driving circuit 100. The driving circuit 100 may be any of the driving circuits described above for driving the light source module and providing enough for the LED load 30.

While the present disclosure has been described in detail with reference to specific embodiments thereof, it will be understood by those skilled in the art that many modifications and variations can be made in the present disclosure. It is, therefore, to be understood that the appended claims are intended to cover all such modifications and variations insofar as they are within the true spirit and scope of the disclosure.

What we claim is:

1. An LED driver, comprising:

a main circuit comprising a front-end stage configured to receive an AC input voltage and output a DC bus voltage, and a back-end stage; and a controller configured to receive a dimming signal, via an external source, for dimming an LED load and use a current hysteresis control in accordance with the dimming signal to generate a control signal, wherein the back-end stage is configured to receive the DC bus voltage and responsive to the control signal, output a desired drive current through output terminals to the LED load so as to produce a target illumination intensity;

wherein a hysteresis width of the current hysteresis control varies with the dimming signal such that one of:

an average value of an inductor current gradually reduces and a difference between the peak-to-peak values of the inductor current gradually decreases, or an average value of the inductor current gradually reduces as the dimming signal is reduced, and a difference between peak-to-peak values of the inductor current changes stepwise as the hysteresis width changes.

2. The LED driver as claimed in claim 1, wherein the back-end stage comprises a controllable switch, the control signal is provided to the controllable switch to switch on or switch off the controllable switch, so that the desired drive current varies within the hysteresis width.

3. The LED driver as claimed in claim 2, wherein the controller comprises a first module and a second module and the back-end stage further comprises an inductor;

wherein the first module is configured to determine an upper limit current and a lower limit current of the current hysteresis control based on the dimming signal; and wherein the second module is configured to detect an inductor current flowing through the inductor and switch on or switch off the controllable switch based on the detected inductor current, when the inductor current reaches the upper limit current, the controllable switch is switched off and when the inductor current reaches the lower limit current, the controllable switch is switched on.

4. The LED driver as claimed in claim 2, wherein the controller comprises a first module, a second module and an auxiliary circuit, wherein the first module is configured to receive the dimming signal and generate an upper limit current according to the dimming signal;

wherein the auxiliary circuit comprises an auxiliary capacitor and an auxiliary resistor, one terminal of the auxiliary capacitor is grounded and the other terminal of the auxiliary capacitor is connected with one terminal of the auxiliary resistor, the other terminal of the auxiliary resistor is connected with a positive terminal of the output terminals, and the other terminal of the auxiliary capacitor is connected to the second module so as to provide a capacitor voltage of the auxiliary capacitor to the second module; and wherein the second module is configured to detect a switch current flowing through the controllable switch and switch on or switch off the controllable switch based on the detected switch current, when the switch current reaches the upper limit current, the controllable switch is switched off, and when the capacitor voltage reaches a threshold voltage, the controllable switch is switched on; and wherein the hysteresis width is determined by a charging time required by the auxiliary capacitor charged from zero voltage to the threshold voltage.

5. The LED driver as claimed in claim 4, wherein the first module is further configured to produce the threshold voltage based on the dimming signal and provide the threshold voltage to the second module.

6. The LED driver as claimed in claim 4, wherein the auxiliary circuit further comprises a transistor connected in series between the auxiliary resistor and the auxiliary capacitor;

wherein the first module is further configured to provide an auxiliary control signal according to the dimming signal to a base electrode of the transistor for changing an equivalent resistance of the transistor, and the charging time of the auxiliary capacitor is adjusted by the equivalent resistance of the transistor.

7. The LED driver as claimed in claim 4, wherein the auxiliary circuit further comprises a second controllable switch connected in series between the auxiliary resistor and the auxiliary capacitor;

wherein the first module is further configured to provide an auxiliary control signal according to the dimming signal to a control electrode of the second controllable switch (for changing an average charging current of the auxiliary capacitor, and the charging time of the auxiliary capacitor is adjusted by the average charging current of the auxiliary capacitor.

8. The LED driver as claimed in claim 4, wherein the hysteresis width has a first hysteresis width and a second hysteresis width, and the first hysteresis width is larger than the second hysteresis width, and the auxiliary circuit further comprises a branch for changing a charging current of the auxiliary capacitor based on the received dimming signal, so that the auxiliary capacitor has a first charging time and a second charging time; and wherein when the dimming signal is above a predetermined value, the auxiliary capacitor has the first charging time and the first hysteresis width is generated;

when the dimming signal is below the predetermined value, the auxiliary capacitor has the second charging time and the second hysteresis width is generated.

9. The LED driver as claimed in claim 8, wherein the branch is connected in parallel with the auxiliary capacitor and comprises a third controllable switch and a third auxiliary capacitor connected in series with the third controllable switch;

wherein the first module is further configured to provide an auxiliary control signal according to the dimming signal to a control electrode of the third controllable switch; and wherein when the dimming signal is above the predetermined value, the third controllable switch is switched on and the auxiliary capacitor has the first charging time; when the dimming signal is below the predetermined value, the third controllable switch is switched off, and the auxiliary capacitor has the second charging time.

10. An LED lamp for connecting to an external power supply, comprising:

an LED load including a plurality of LEDs; and an LED driver configured for driving the LED load, the LED driver comprising:

a main circuit comprising a front-end stage configured to receive an AC input voltage and output a DC bus voltage, and a back-end stage; and a controller configured to receive a dimming signal, via an external source, for dimming an LED load and use a current hysteresis control in accordance with the dimming signal to generate a control signal, wherein the back-end stage is configured to receive the DC bus voltage and responsive to the control signal, output a desired drive current through output terminals to the LED load so as to produce a target illumination intensity, wherein a hysteresis width of the current hysteresis control varies with the dimming signal such that one of:

an average value of an inductor current gradually reduces and a difference between the peak-to-peak values of the inductor current gradually decreases, or an average value of the inductor current gradually reduces as the dimming signal is reduced, and a difference between peak-to-peak values of the inductor current changes stepwise as the hysteresis width changes.

* * * * *